US006652323B2

(12) United States Patent
Yanda

(10) Patent No.: US 6,652,323 B2
(45) Date of Patent: Nov. 25, 2003

(54) PRECISION PARKING DEVICE

(76) Inventor: Leon M. Yanda, 1104 Hwy. 156 West, West Fork, AR (US) 72774

( * ) Notice: Subject to any disclaimer, the term of this patent is extended or adjusted under 35 U.S.C. 154(b) by 0 days.

(21) Appl. No.: 10/077,112

(22) Filed: Feb. 19, 2002

(65) Prior Publication Data

US 2003/0157840 A1 Aug. 21, 2003

(51) Int. Cl.[7] ..... H01R 25/00
(52) U.S. Cl. ..... 439/642; 439/502
(58) Field of Search ..... 439/642, 643, 439/502

(56) References Cited

U.S. PATENT DOCUMENTS 5,430,331 A * 7/1995 Bohlen et al. ..... 439/502
5,954,538 A * 9/1999 Huang ..... 439/502
6,162,100 A * 12/2000 Al-Turki ..... 439/642

FOREIGN PATENT DOCUMENTS

DE 2817122 * 10/1979 ..... 439/642

* cited by examiner

*Primary Examiner*—Gary Paumen
(74) *Attorney, Agent, or Firm*—Keisling Pieper & Scott PLC; Trent C. Keisling; David B. Pieper

(57) ABSTRACT

A light source switched on and off by direct means or being signaled to be switched by an alternate mechanism, and powered by direct electrical circuits, derivations of such direct circuits, or direct battery sources, to power said light source to shine such that a vehicle/equipment can be maneuvered to bring said light source to the same location on the vehicle/equipment thereby providing precise location of the vehicle/equipment.

4 Claims, 1 Drawing Sheet

PRECISION PARKING DEVICE

FIELD OF THE INVENTION

The invention is a light source that is mounted to shine such that a vehicle/equipment can be maneuvered to bring the light source to shine on a pre-selected location on the vehicle/equipment resulting in the vehicle/equipment being repeatedly parked in a precise location as desired. Other parking devices use proximity sound devices that are measurably less accurate and are one-dimensional (fore and aft) only. Another device includes an object that is hung down so the driver can maneuver the vehicle/equipment to bring the hanging object to a predetermined location on the vehicle/equipment. Such hanging devices are continuously hanging in the way when the vehicle is not parked in the space, thereby limiting other uses of the parking location. There is a need for a device that assists a driver to maneuver a vehicle to be more precisely located, i.e., two dimensionally (fore and aft as well as side to side) for greater accuracy in parking and to allow clear alternate use of the space.

SUMMARY OF THE INVENTION

The invention includes a bright precision light (laser light or other bright light) that is attached to a facility structure such that it can be aimed to a predetermined location as desired. The light can be switched on and off by direct means, but preferably be made to switch on and off by the garage door opener electrical circuit. The switching mechanism can be by manual switch, photocell control from the garage door opener light, or can be made to switch on and off along with the garage door opener light bulb. Power for the light can be by alternate direct electrical circuits, battery power, or can be powered by a low voltage circuit tied into the garage door opener light circuit. Preferable operation of the light is to have wiring circuits such that the precision parking light is powered by and comes on and off with the garage door opener timed light.

The invention includes a screw-in adapter for the garage door opener light bulb socket, and provides an alternate light bulb socket along with a pigtail wire and electrical plug. A low voltage ac-dc adapter is provided to plug into the electrical plug, and provides low voltage power for the precision light source(s). One or more precision light sources can be controlled by the same circuit to provide parking lights in a doublewide (or more) garage if desired. After making the electrical connections of the invention, the vehicle/equipment can be precisely parked as desired. The light is then mounted to the ceiling of the parking garage in such location to shine down on a predetermined location (probably a prominent location such as for a vehicle, the edge of the dash and in line with the steering wheel, or other such convenient location). The vehicle/equipment can thereafter be maneuvered such that the light comes to shine in the desired predetermined location to cause the vehicle/equipment to always be parked in the same location, both fore and aft and side to side.

DESCRIPTION OF THE PREFERRED EMBODIMENT

Figure 1:
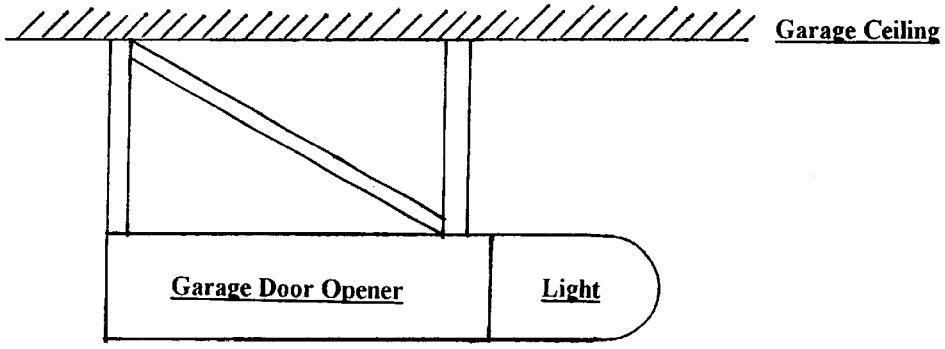
FIG. 1 is a diagrammatic view of a standard home or business garage door opener mounted to the surface of the facility.
Figure 2:
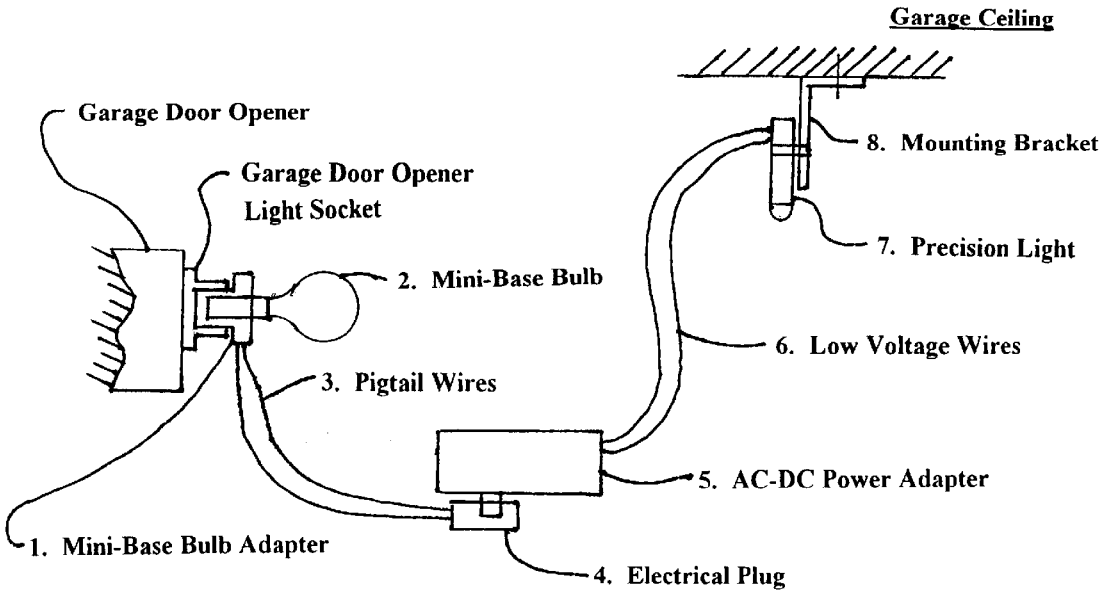
FIG. 2 is a diagrammatic view of the garage door opener light and invention parts with connected wiring.

Referring particularly to FIG. 2, a mini-base/standard bulb adapter 1 is screwed into the existing garage door opener light socket. A mini-base light bulb 2 is screwed into the adapter. Pigtail wires 3 connect to the electrical plug 4. A standard ac-dc power adapter 5 plugs into the electrical plug 4. Low voltage wires 6 connect to the precision light 7. The precision light 7 is attached to mounting bracket 8 that is in turn attached to the garage ceiling.

A second version of the invention would replace the mini-base/standard bulb adapter 1, mini-base light bulb 2, pigtail wires 3, and electrical plug 4 with an alternate switched facility electrical circuit. The remainder of the invention would remain the same.

A third version of the invention would replace the mini-base/standard bulb adapter 1, mini-base light bulb 2, pigtail wires 3, and electrical plug 4 with a photo-electric cell (to sense when the garage door opener light was on or off) with wires connecting to a low voltage battery replacing the ac-dc power adapter 5. The remainder of the invention would remain the same.

DESCRIPTION OF OPERATION

Starting with the mini-base/standard bulb adapter 1 in which electrical power is provided from the garage door opener's timed light circuit, the following events occur:

Electrical power is provided to the mini-base light bulb 2, thereby providing the normal garage door opener light. Electrical power is also provided through the pigtail wires 3 to the electrical plug 4 and ac-dc power adapter 5. The low voltage wires 6 provide dc power to the precision light 7, thereby providing the precision light shining down on the vehicle/equipment below. Any vehicle/equipment is then maneuvered to cause the precision light to shine down upon a predetermined location on the vehicle/equipment, thereby precisely locating the vehicle/equipment within the facility.

I claim:

1. A electrical plug apparatus for a light bulb socket, the apparatus comprising:

a bulb adapter adapted to electrically connect to the light bulb socket;

a pigtail wire distally extending from the bulb adapter, the pigtail wire electrically connected to the socket adapter; and an electrical plug electrically connected to the pigtail wire.

2. The apparatus of claim 1, the socket adaptor comprising:

a screw in adapter.

3. The apparatus of claim 1, the socket adaptor comprising:

an alternate bulb socket electrically connected to the bulb adapter.

4. The apparatus of claim 1, the socket adaptor comprising:

a standard socket base adapted to screw into the light bulb socket; and a mini-base adapter socket electrically connected to the standard bulb base.

* * * * *